US005087030A

United States Patent [19]

Jones

[11] Patent Number: 5,087,030

[45] Date of Patent: Feb. 11, 1992

[54] ROLLER SKATING RINK

[76] Inventor: Kirk Jones, 3304 Great Neck Rd., Copiague, N.Y. 11726

[21] Appl. No.: 539,690

[22] Filed: Jun. 18, 1990

[51] Int. Cl.[5] ..... A63C 10/10

[52] U.S. Cl. ..... 272/3; 62/235

[58] Field of Search ..... 272/3-5, 272/56.5 R, 56.5 SS; 62/235; 404/40

[56] References Cited

U.S. PATENT DOCUMENTS

| | | | |
|---|---|---|---|
| 2,996,896 | 8/1961 | Johnson | 62/235 |
| 3,012,596 | 12/1961 | Skolout | 62/235 |
| 3,771,891 | 11/1973 | Nirenski et al. | 404/40 |
| 3,797,049 | 3/1974 | DeSanto | 62/235 X |
| 3,808,831 | 5/1974 | Landry | 272/3 X |
| 3,930,647 | 1/1976 | Berlemont | 272/3 |
| 4,172,593 | 10/1979 | Palakanis | 272/3 |

FOREIGN PATENT DOCUMENTS

| | | | |
|---|---|---|---|
| 387090 | 6/1908 | France | 62/235 |

*Primary Examiner*—Richard E. Chilcot, Jr.
*Attorney, Agent, or Firm*—Michael I. Kroll

[57] ABSTRACT

The roller skating ring for small children has a thick hexagonal plastic floor of a size which can fit in a yard or basement of a single-family home. It has six equal supporting side boards attached to the bottom of the substantially flat floor adjacent its lateral edges and a plurality of supporting members also attached underneath the floor to form a strong honeycomb-like supporting structure. A barrier means is attached to the flat floor adjacent the lateral edges of the floor to prevent skaters from skating off it and may comprise a plurality of equal-size poles mounted in the floor adjacent its corners with two side rails connecting each of the poles with a laterally adjacent pole. An entrance means for ingress and egress of skaters is provided with a substantially flat, padded entrance board slidably mounted in brackets on two laterally adjacent poles and a padded sidewalk is attached adjacent a plurality of the lateral edges of the flat floor.

12 Claims, 2 Drawing Sheets

Fig. 1
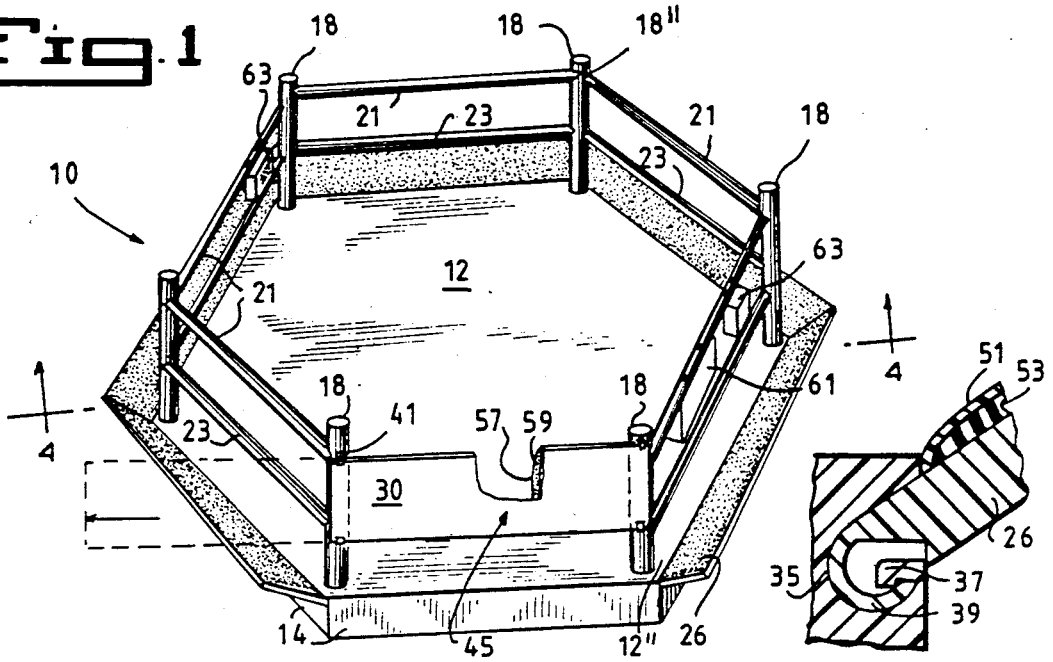
Fig. 3
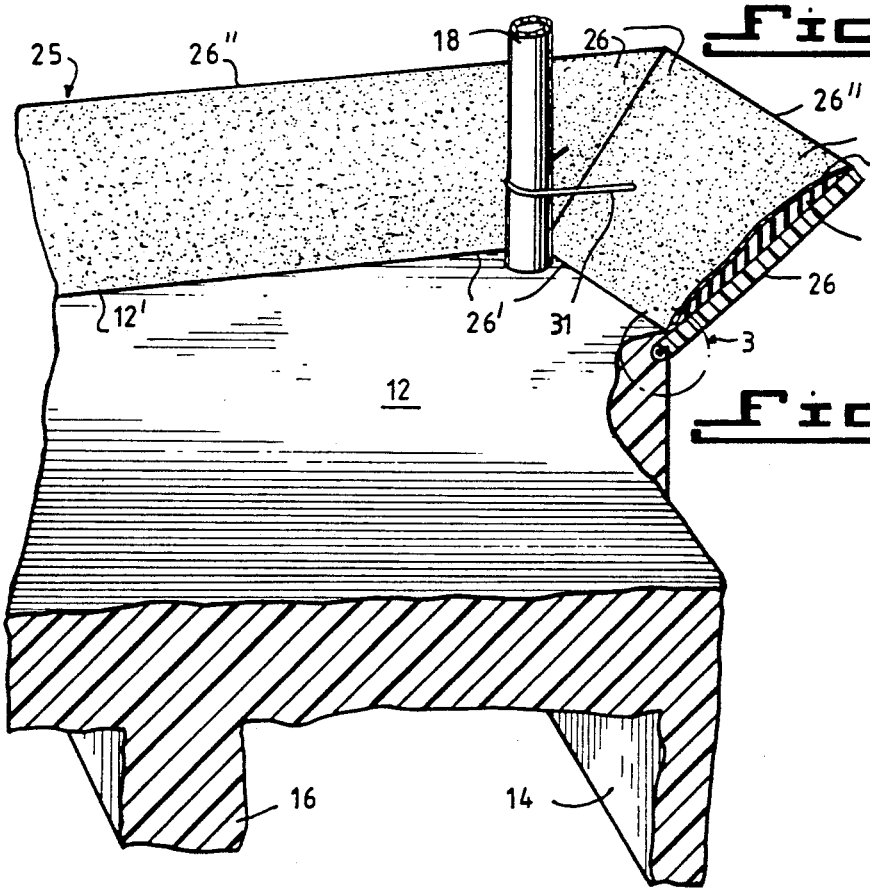
Fig. 2

Fig. 4
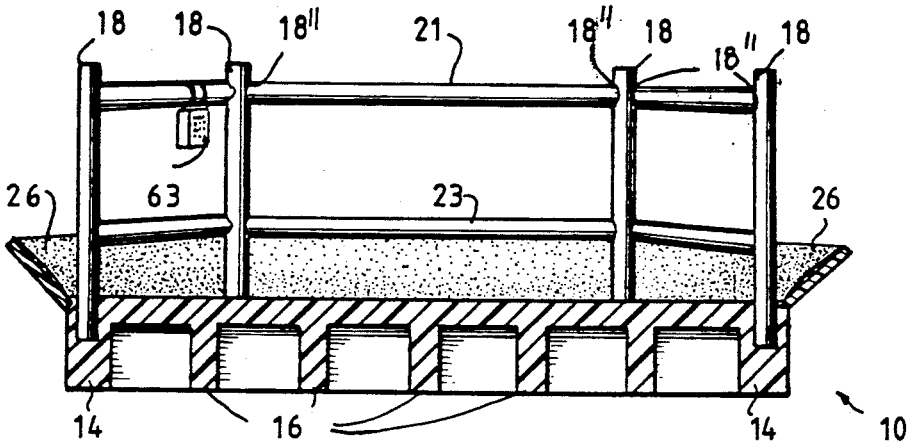
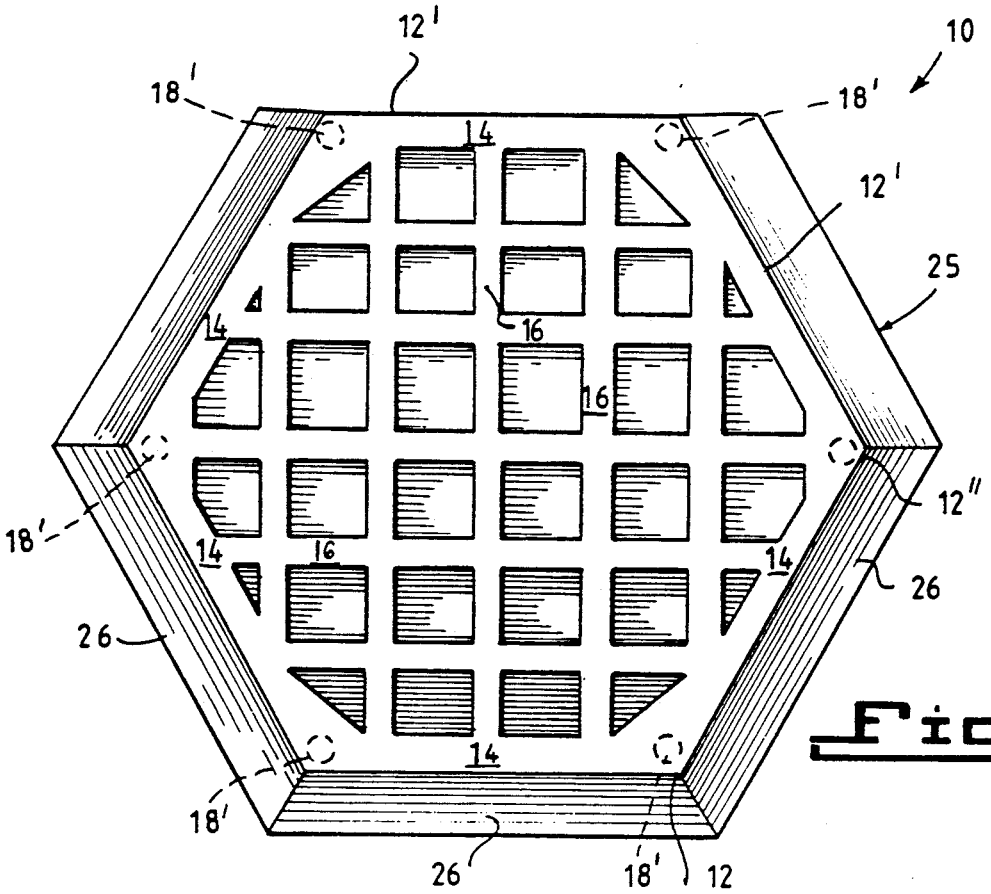
Fig. 5

ROLLER SKATING RINK

THE FIELD OF THE INVENTION

The present invention relates to toys for four to ten year old children and, more particularly, to a roller skating rink for children.

THE BACKGROUND OF THE INVENTION

A pair of roller skates can be a substantial source of amusement for a young child, who is about four to ten years old, relieving the parent of the need of providing the child with attention. However in a suburb without sidewalks or a city with heavy traffic on the streets a child on roller skates can be a great danger both to himself or herself or even to other pedestrians. Alternatively a parent can insist that roller skates be used only on a local roller skating rink. Then a special trip to the roller skating rink is necessary involving time and effort by the parent. Furthermore the roller skating rink will charge for its services involving additional expenditures.

It is a general object of the present invention to provide a comparatively safe place in the home or in a backyard adjacent the home where children ages four to ten may roller skate.

It is another object of the present invention to provide a comparatively compact, light, easily assembled roller skating rink for a comparatively small number of four to ten year old children.

It is another object of the instant invention to provide a roller skating rink for four to ten year old children, which can hold up to six children and which can be used in the limited space typically available to children in a single-family home.

It is a further object of the present invention to provide a roller skating rink for four to ten year old children, which can hold up to six children and be easily assembled and used in a basement or backyard of the typical single-family home or apartment, in a school yard and/or some other recreational facility which may have only limited available space.

SUMMARY OF THE INVENTION

According to the present invention the roller skating rink for children ages four to ten comprises a substantially flat floor, made from a solid piece having a plurality of lateral edges and corners and of a size which can fit in a single-family home or an adjacent yard, a barrier means attached to the flat floor adjacent its lateral edges to prevent skaters from skating off the floor and to prevent those who are not skaters from entering and interfering and entrance means in the barrier means for ingress and egress of the skaters.

With the roller skating rink according to the present invention small children can safely roller skate at home without parental worry that they may be involved in an accident on a local street. Furthermore it is not necessary to make a special trip to a large roller skating rink involving parental loss of time and expense. The roller skating rink is easily assembled with rustproof screws without rough edges. The advantageously thick plastic hexagonal floor can hold six or more children ages four to ten. It must of course be much smaller than a conventional roller skating rink and is therefore only practical for children who are small enough to appreciate it.

Several forms of the present invention are possible. The substantially flat floor may comprise a nearly hexagonal plastic piece which is at least 9 inches thick. It may have six substantially equal supporting side boards also made of plastic attached to its bottom adjacent its lateral edges. It may further comprise a plurality of supporting members of the same height as the supporting side boards attached underneath the substantially flat floor to form a particularly strong honeycomb-like supporting structure.

The barrier means may comprise a plurality of equal-sized poles mounted in the floor adjacent its corners and a plurality of side rails connecting each of the poles with a laterally adjacent poles. Advantageously two side rails are connected between laterally adjacent poles however the space between two laterally adjacent poles may be used for the entrance means. The entrance means may comprise a substantially flat, padded entrance board slidably mounted in two brackets on each of the two laterally adjacent poles.

A sidewalk may be attached adjacent a plurality of the lateral edges of the flat floor. It comprises a plurality of trapezoidal-shaped sidewalk boards each having an inner edge and an outer edge. The inner edge is of the same length as a lateral edge, is connected to the supporting side wall adjacent the lateral edge by a modified tongue and groove joint and is supported by two supporting straps slung around laterally adjacent poles. These two supporting straps are each anchored to an adjacent sidewalk board. The modified tongue and groove joint has a linear groove in the supporting side wall having an inward-extending lower lip and a curved tongue on the inner edge of the sidewalk board which engages under the lower lip. Each of the sidewalk boards may be padded with a cloth or plastic covering and interior stuffing, e.g. polystyrene foam.

A radio/cassette/CD player may be suspended with speakers on the side rails to provide music for skating.

DETAILED DESCRIPTION OF THE DRAWING FIGURES

FIG. 1 is a perspective view of a roller skating rink for children according to the present invention.

FIG. 2 is a cutaway view of the roller skating rink of FIG. 1 showing construction details.

FIG. 3 is a detailed cross sectional view of the portion of the roller skating rink of FIG. 1 indicated in the dot-dashed circle in FIG. 2.

FIG. 4 is a partially side elevational, partially cross sectional view of the roller skating rink of FIG. 1.

FIG. 5 is a bottom plan view of the roller skating rink of FIG. 1.

DETAILED DESCRIPTION OF THE INVENTION

The roller skating rink 10 shown in FIGS. 1–5 comprises a substantially flat, hexagonal floor 12, six supporting side boards 14 connected adjacent the lateral edges 12' of the hexagonal floor 12, a plurality of supporting members 16 beneath the floor 12 on which rest on the floor, six poles 18 mounted in six holes 12" at the corners of the hexagonal floor 12 and five pairs of side rails including a top side rail 21 and a bottom side rail 23 attached between laterally adjacent pairs of poles 18. It also has a sidewalk 25 comprising five sidewalk boards 26 each having a sidewalk pad 28 connectable to the side boards 14 at each of the lateral edges 12' of the hexagonal floor 12.

Adjacent one of the lateral edges 12' of the floor 12 instead of the side rails 21,23 a detachable padded entrance board 30 is provided which slides on and off the poles 18. Also at this lateral edge 12' where the entrance board 30 is located the sidewalk board 26 is omitted.

The hexagonal floor 12 is advantageously made of plastic and may be 12 inches thick so that it can support up to a thousand pounds holding up to six children on roller skates.

The six substantially rectangular supporting side boards 14 are connected substantially perpendicularly to the lateral edges 12' of the hexagonal floor. They are of the same length as the lateral edges 12'. They have a width equal to the desired height of the floor 12 and a thickness so that, together with the supporting members 16, they support the hexagonal floor 12.

The supporting members 16 are also substantially rectangular and arranged perpendicular to the floor 12 underneath it. Together they form a honeycomb-like structure as shown in FIG. 5. FIG. 5 also shows that the supporting side boards 14 can be somewhat thicker at the ends near the corners 12" to provide additional support for the poles 18.

The equal-sized poles 18 are inserted and held in pole holes 18' in the hexagonal floor 12 adjacent the corners 12". These poles 18 may be hollow to aid in reducing the weight of the skating rink 10.

Five pairs of side rails 21, 23 are attached between the laterally adjacent poles 18 at locations corresponding to five of the six lateral edges 12'. The top side rails 21 and the bottom side rails 23 are all at the same height from the hexagonal floor 12. They can be attached to the poles 18 with rustproof screws after being set in mounting recesses 18".

The sidewalk 25 comprises a series of sidewalk boards 26. These sidewalk boards 26 are trapezoidal shaped. The inner edge 26' of the sidewalk board 26 is substantially equal to the edge 12' of the hexagonal floor 12. However the outer edge 26" of the sidewalk board 26 is substantially longer than their inner edge 26' so that, when the sidewalk board lateral edges 24 of the sidewalk boards 26, are joined the sidewalk boards 26 are neither vertical nor substantially flat. The sidewalk board lateral edges 24 are oriented at an angle of from 60 to 90 degrees to the outer edge 26". Thus all the sidewalk boards 26 are oriented at the same acute angle to the hexagonal floor 12.

The sidewalk boards 26 can be supported at their adjoining ends by a supporting strap 31 attached to the front surface of adjoining ends of adjacent sidewalk boards 26 and slung around the adjacent pole 18.

A sidewalk board 26 can be attached to a supporting side board 14 adjacent the edge 12' of the hexagonal floor 12 by a modified tongue and groove joint 33 comprising a groove 35 running along the length of the supporting side board 14 with an inward-extending lower lip 37 and a curved (nearly semicircular) tongue 39 on the inner edge 26' of the sidewalk board 26. The groove 35 is conformed so that the tongue 39 fits in it and the front edge of the tongue 39 engages under the inward-extending lip 37. Since the sidewalk boards 26 and the side boards 14 are made of deformable plastic material, the sidewalk board 26 may be easily inserted in the groove 35 of the side board 14.

Two brackets 41 are provided on two adjacent poles 18 at the end of an edge 12' where the entrance 45 to the roller skating rink 10 is provided. These brackets 41 are positioned to hold a rectangular, padded entrance board 30 which is slidable in them.

The sidewalk boards 26 have a sidewalk pad 28 attached. This sidewalk pad 28 comprises an advantageously cloth or plastic covering 51 and interior stuffing, e.g. polystyrene foam, 53. Similarly the entrance board 30 has a entrance board pad 55 comprising a cloth or plastic covering 57 and stuffing 59 inside of it. The stuffing 59 can also be polystyrene foam.

The roller skating rink can also be provided with a radio/cassette/CD player 61 with speakers 63 which are suspended from the side rails 21, 23.

An additional entrance may be provided by omitting another sidewalk board 26 and associated side rails 21, 23.

The roller skating rink 10 must be of a size which is convenient for the average family with small children to assemble, disassemble and use. A preferred size for this roller skating rink 10 is such that the distance across it is about 10 feet.

By "single-family home" in the following we mean the typical suburban or urban home which has rooms which range in size from about 10 feet×10 feet to 30 feet×30 feet. This type of house seldom has rooms which have width or length dimensions over thirty feet and the above roller skating rink is not contemplated to require room dimensions larger than that. Furthermore such a "single-family home" has an outdoor yard area which can be used for this roller skating rink which is at maximum 30 feet×30 feet.

It will be understood that each of the elements described above, or two or more together, may also find a useful application in other devices differing from the type of device described above.

The invention is not intended to be limited to the details provided above and it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed is new and what is desired to be protected by Letters Patent is:

1. A roller skating ring for children comprising:

a substantially flat floor made from a solid piece having a plurality of lateral edges and corners, which is of a size which can fit in a yard or basement of a single-family home;

a barrier means attached to said floor adjacent said lateral edges to prevent skaters from skating off said floor and to prevent those who are not said skaters from entering and interfering with said skaters; and entrance means in said barrier means for ingress and egress of said skaters.

2. A roller skating rink according to claim 1 in which said substantially flat floor comprises a nearly hexagonal plastic piece and is at least 9 inches thick.

3. A roller skating rink according to claim 2 further comprising six substantially equal supporting side boards also made of plastic attached to the bottom of said substantially flat floor adjacent said lateral edges.

4. A roller skating rink according to claim 3 further comprising a plurality of supporting members of the same height as said supporting side boards attached underneath said substantially flat floor to form a honeycomb-like supporting structure.

5. A roller skating rink according to claim 1 in which said barrier means comprise a plurality of equal-sized poles mounted in said floor adjacent said corners and a plurality of side rails connecting each of said poles with a laterally adjacent one of said poles.

6. A roller skating rink according to claim 5 in which said substantially flat floor comprises a hexagonal piece and two of said side rails connect each of said poles with said laterally adjacent pole.

7. A roller skating rink according to claim 5 in which said entrance means comprises a substantially flat, padded entrance board slidably mounted in two brackets on each of two of said poles which are laterally adjacent.

8. A roller skating rink according to claim 1 also including a sidewalk attached to a plurality of said lateral edges of said substantially flat floor.

9. A roller skating rink according to claim 8 wherein said sidewalk comprises a plurality of trapezoidal-shaped sidewalk boards each having an inner edge and an outer edge, said inner edge being of the same length as one of said lateral edges and being connected to said supporting side wall adjacent said lateral edge by a modified tongue and groove joint and being supported by two supporting straps slung around two adjacent ones of said poles, each of which are attached to an adjacent one of said sidewalk boards.

10. A roller skating rink according to claim 9 in which said modified tongue and groove joint comprises a linear groove in said supporting side wall having an inward-extending lower lip and a curved tongue on the inner edge of said sidewalk board engagable under said lower lip.

11. A roller skating rink according to claim 9 in which each of said sidewalk boards is padded and has a cloth or plastic covering with interior stuffing.

12. A roller skating ring for children comprising:

a substantially flat floor made from a solid hexagonal plastic piece having six of lateral edges and corners which is of a size which can fit in a yard or basement of a single-family home, said flat foot having six substantially equal supporting side boards also made of plastic attached to the bottom of said substantially flat floor adjacent said lateral edges and a plurality of supporting members of the same height as said supporting side boards attached underneath said substantially flat floor to form a honeycomb-like supporting structure;

a barrier means attached to said flat floor adjacent said lateral edges to prevent skaters from skating off said floor and to prevent those who are not said skaters from entering and interfering, said barrier means comprising a plurality of equal-sized poles mounted in said floor adjacent said corners and two side rails connecting each of said poles with a laterally adjacent one of said poles;

entrance means in said barrier means for ingress and egress of said skaters comprising a substantially flat, padded entrance board slidably mounted in two brackets on two said poles which are laterally adjacent; and a sidewalk attached to a plurality of said lateral edges of substantially flat floor comprising a plurality of trapezoidal-shaped sidewalk boards each having an inner edge and an outer edge, said inner edge being of the same length as said lateral edge, being connected to said supporting side wall adjacent said lateral edge by a modified tongue and groove joint and being supported by two supporting straps slung around two of said poles which are laterally adjacent.

* * * * *